US008734124B2

(12) United States Patent
Hatta et al.

(10) Patent No.: US 8,734,124 B2
(45) Date of Patent: May 27, 2014

(54) SWASH PLATE TYPE COMPRESSOR

(75) Inventors: Masaharu Hatta, Toyota (JP); Masanori Akizuki, Toyota (JP); Satoshi Nomura, Toyota (JP); Hiroshi Kanemitsu, Toyota (JP)

(73) Assignee: Taiho Kogyo Co., Ltd., Toyota-shi, Aichi (JP)

( * ) Notice: Subject to any disclaimer, the term of this patent is extended or adjusted under 35 U.S.C. 154(b) by 1114 days.

(21) Appl. No.: 12/733,579

(22) PCT Filed: Nov. 26, 2009

(86) PCT No.: PCT/JP2009/069928

§ 371 (c)(1),
(2), (4) Date: Mar. 9, 2010

(87) PCT Pub. No.: WO2010/087067

PCT Pub. Date: Aug. 5, 2010

(65) Prior Publication Data

US 2011/0158829 A1 Jun. 30, 2011

(30) Foreign Application Priority Data

Jan. 30, 2009 (JP) ..... 2009-019539
May 28, 2009 (JP) ..... 2009-128561

(51) Int. Cl.
*F04B 53/14* (2006.01)

(52) U.S. Cl.
USPC ..... 417/222.1

(58) Field of Classification Search
USPC ..... 74/60; 91/502; 92/12.2, 71, 129; 417/222.1, 271
See application file for complete search history.

(56) References Cited

U.S. PATENT DOCUMENTS

| | | | | |
|---|---|---|---|---|
| 7,357,067 | B2 * | 4/2008 | Galba | 92/71 |
| 2008/0028877 | A1 * | 2/2008 | Kanemitsu et al. | 74/60 |

FOREIGN PATENT DOCUMENTS

| | | | | |
|---|---|---|---|---|
| JP | 57-042180 | | 3/1982 | |
| JP | 09-072276 | | 3/1997 | |
| JP | 11-037041 | | 2/1999 | |
| JP | 2001-003858 | | 1/2001 | |
| JP | 2001003858 | * | 1/2001 | F04B 27/08 |
| JP | 2002-276543 | | 9/2002 | |
| JP | 3803135 | | 5/2006 | |
| JP | 2006-161801 | | 6/2006 | |
| JP | 4149056 | | 7/2008 | |
| WO | WO 02/075172 | | 9/2002 | |

* cited by examiner

*Primary Examiner* — Bryan Lettman
(74) *Attorney, Agent, or Firm* — Flynn, Thiel, Boutell & Tanis, P.C.

(57) ABSTRACT

A swash plate type compressor includes a swash plate rotating around a rotating shaft, pistons that advance and retreat with the rotation of the swash plate and formed with a hemispherical concave sliding surface, and shoes formed with a flat end surface part in sliding contact with the swash plate and a spherical surface part in sliding contact with the sliding surface of the piston. A cylindrical part is formed between the spherical surface part and the end surface part of the shoe, and the shoe is formed with a flange part that surrounds the boundary portion between the cylindrical part and the end surface part and is in sliding contact with the swash plate. Further, the flange part is located on the inside of an imaginary spherical surface including the sliding surface of the piston.

9 Claims, 3 Drawing Sheets

SWASH PLATE TYPE COMPRESSOR

TECHNICAL FIELD

The present invention relates to a swash plate type compressor. More particularly, it relates to a swash plate type compressor including a swash plate rotating with a rotating shaft, pistons advancing and retreating with the rotation of the swash plate, and shoes formed with an end surface part in sliding contact with the swash plate and a spherical surface part in sliding contact with a hemispherical concave sliding surface formed in the piston.

BACKGROUND ART

Conventionally, there has been known a swash plate type compressor including a swash plate rotating with a rotating shaft, pistons that advance and retreat with the rotation of the swash plate and are formed with a hemispherical concave sliding surface, and shoes formed with a flat end surface part in sliding contact with the swash plate and a spherical surface part in sliding contact with the sliding surface of the piston.

As such a swash plate type compressor, there has been known a compressor in which a wedge-shaped space is formed between the sliding surface of the piston and the spherical surface part of the shoe, and a lubricant or refrigerant is caused to flow into the space to perform lubrication (Patent Documents 1 to 3).

PRIOR ART DOCUMENTS

Patent Document

Patent Document 1: Japanese Patent No. 4149056
Patent Document 2: Japanese Patent Laid-Open No. 2001-3858
Patent Document 3: Japanese Patent No. 3803135

Problems to be Solved by the Invention

Technical Problem

For the swash plate type compressor described in Patent Document 1, the space formed between the sliding surface of the piston and the spherical surface part of the shoe is very small, so that the configuration is not such that a lubricant or refrigerant is allowed to flow into the space positively.

For the swash plate type compressor described in Patent Document 2, when a flange part formed at the outer periphery of the shoe comes close to the opening of the sliding surface of the piston, the flange part inhibits the inflow of lubricant into the space, so that sufficient lubrication cannot be provided.

For the swash plate type compressor described in Patent Document 3, a tapered part is formed on the side surface of the shoe, a space is formed between the sliding surface of the piston and the spherical surface part of the shoe, and the space is open to the opening of the sliding surface, so that the lubricant cannot be held in the space, whereby the lubrication effect cannot be achieved sufficiently.

The present invention has been made to solve the above problems, and accordingly an object thereof is to provide a swash plate type compressor capable of lubricating a shoe satisfactorily.

Means for Solving the Problems

The inventive swash plate type compressor includes a swash plate rotating with a rotating shaft; a piston which advances and retreats with the rotation of the swash plate and is formed with a hemispherical concave sliding surface; and a shoe formed with a flat end surface part in sliding contact with the swash plate and a spherical surface part in sliding contact with the sliding surface of the piston, and is characterized in that a cylindrical part is formed between the spherical surface part and the end surface part of the shoe, and the shoe is formed with a flange part which projects to the outside in the radial direction from the cylindrical part in the boundary portion between the cylindrical part and the end surface part and is in sliding contact with the swash plate; and the flange part is located on the inside of an imaginary spherical surface including the hemispherical concave sliding surface of the piston, and the diameter of the cylindrical part is smaller than the diameter of the opening of the sliding surface of the piston.

Effects of Invention

According to the above-described invention, since the diameter of the cylindrical part is smaller than the diameter of the opening of the sliding surface of the piston, a space for holding a lubricant can be formed by the hemispherical concave sliding surface and cylindrical part of the piston, whereby the piston and the shoe can be lubricated satisfactorily by this lubricant.

Also, since the flange part is located on the inside of the imaginary spherical surface including the hemispherical concave sliding surface of the piston, the flange part does not inhibit the inflow of lubricant into the space by closing the opening of the hemispherical concave sliding surface of the piston. On the other hand, the flange part inhibits, as far as possible, the lubricant flowing into the space from being discharged to the outside. Therefore, the lubricant can be held in the space.

DESCRIPTION OF EMBODIMENTS

Figure 1:
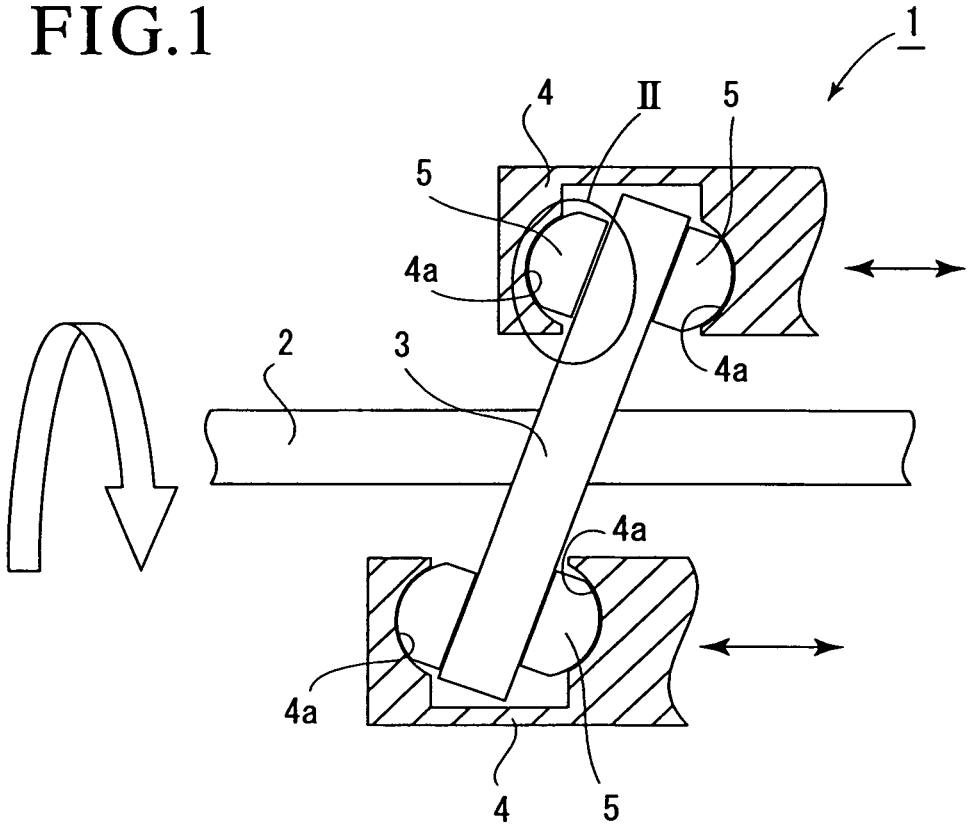
FIG. 1 is a sectional view of a swash plate type compressor.

Embodiments of a swash plate type compressor will now be described with reference to the accompanying drawings. FIG. 1 shows the internal construction of a swash plate type compressor 1, showing a rotating shaft 2 pivotally supported on a housing (not shown), a swash plate 3 mounted to the rotating shaft 2, a plurality of pistons 4 advancing and retreating in a cylinder bore (not shown) of the housing, and a plurality of shoes 5 which are provided so as to face to each other on the inside of the piston 4 and hold the swash plate 3 therebetween.

The swash plate 3 is fixed slantwise with respect to the rotating shaft 2, or the tilt angle of the swash plate 3 can be changed. Each of the pistons 4 is held by two of the shoes 5. A portion being in sliding contact with the shoe 5 of the swash plate 3 is subjected to a required coating such as a thermal sprayed layer, plated layer, or resin coating.

The configuration of the swash plate 3 capable of being used in the present invention is not limited to the above-described one, and various types of conventional publicly-known swash plates can be used.

In the piston 4, hemispherical concave sliding surfaces 4*a* are formed so as to face each other, so that the rotation of the swash plate 3 is converted to the advancing and retreating movement of the piston 4 while the shoe 5 oscillates with respect to the sliding surface 4*a*.

The swash plate type compressor 1 having such a configuration has been publicly known conventionally, so that further explanation thereof is omitted.

Figure 2:
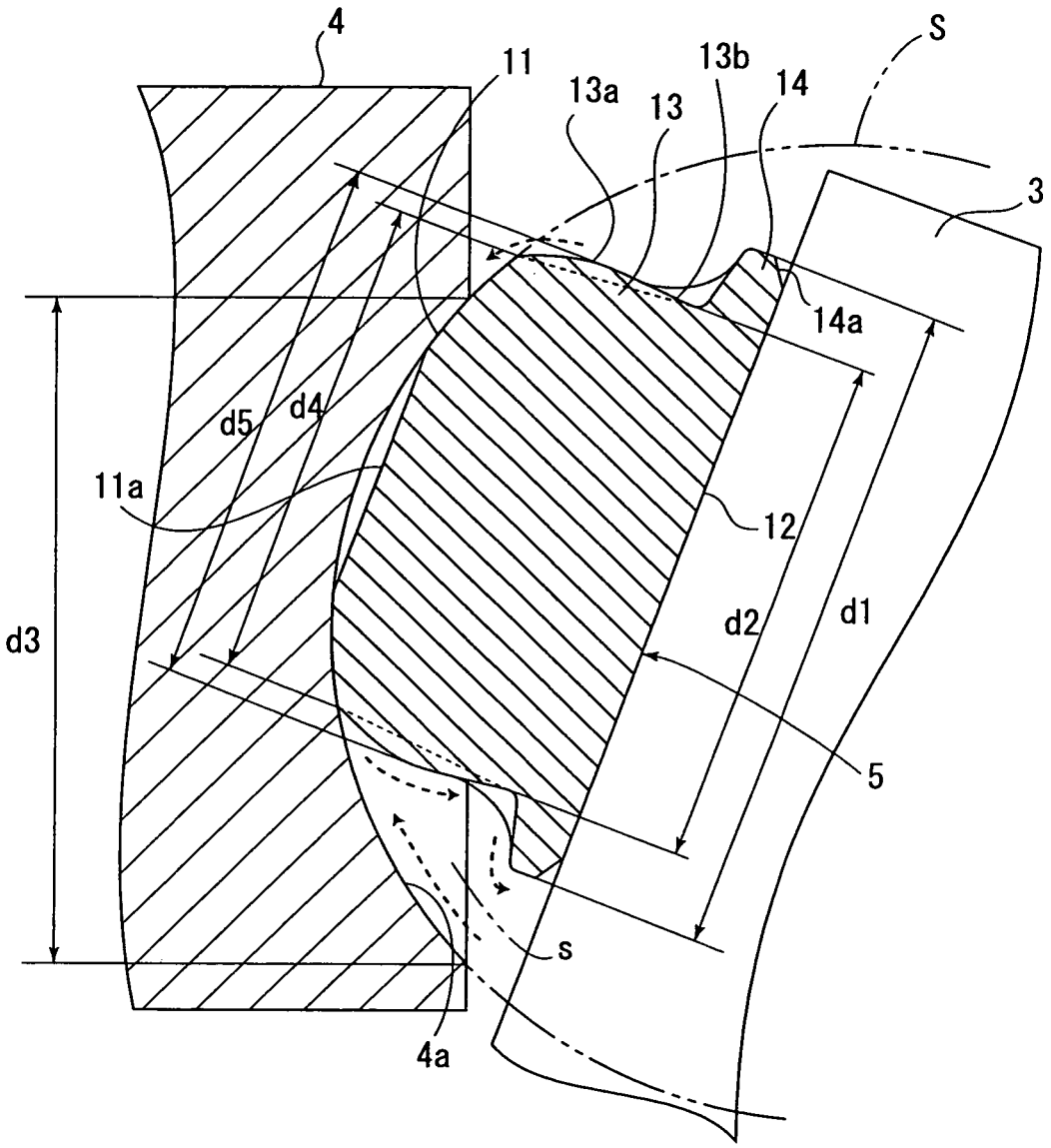
FIG. 2 is an enlarged sectional view of a shoe in a first embodiment.

FIG. 2 is an enlarged sectional view of portion II in FIG. 1. The shoe 5 includes a spherical surface part 11 that is in sliding contact with the sliding surface 4*a* of the piston 4, an end surface part 12 that is in sliding contact with the swash plate 3, a cylindrical part 13 formed between the spherical surface part 11 and the end surface part 12, and a flange part 14 that surrounds a boundary portion between the cylindrical part 13 and the end surface part 12 and is in sliding contact with the swash plate 3.

The shoe 5 can be manufactured of a sintered material or a resin material besides an iron-based, copper-based, or aluminum-based material, being preferably manufactured by forging SUJ2.

The diameter d4 of the spherical surface part 11 is smaller than the diameter d3 of an opening of the sliding surface 4*a* of the piston 4. Also, the vertex portion of the spherical surface part 11 is formed with a relief part 11*a* that is not in contact with the sliding surface 4*a* of the piston 4. Thereby, a lubricant is caused to flow into a space formed between the sliding surface 4*a* and the relief part 11*a*.

The sliding contact surface with the swash plate 3 of the end surface part 12 and the sliding contact surface with the swash plate 3 of the flange part 14 are connected smoothly to each other, and a relief part 14*a* is formed at the outer periphery end on the swash plate 3 side of the flange part 14.

Although not shown in the figure, the sliding contact surface of the end surface part 12 slightly expands to the swash plate 3 side in the center thereof, so that the lubricant is drawn in between the end surface part 12 and the swash plate 3. Further, the relief part 14*a* that is not in sliding contact with the swash plate 3 is formed on the side of the sliding contact surface with the swash plate 3.

In this embodiment, in the cylindrical part 13 of the shoe 5, the diameter d2 on the end surface part 12 side is larger than the diameter d4 of the spherical surface part 11, and the diameter d2 is smaller than the diameter d3 of the opening of the sliding surface 4*a* of the piston 4. The diameter d2 on the end surface part 12 side and the diameter d4 of the spherical surface part 11 may be equal to each other.

For the outer peripheral surface of the cylindrical part 13, an intermediate portion of the cylindrical part 13 between the spherical surface part 11 and the end surface part 12 is formed as an expanded part 13*a* expanded to the outside in the radial direction, and a constricted part 13*b* having a diameter smaller than that of the expanded part 13*a* is formed between the expanded part 13*a* and the flange part 14.

Specifically, the diameter d5 of the expanded part 13*a* is larger than the diameter d4 of the spherical surface part 11 and the diameter d2 on the end surface part 12 side of the cylindrical part 13.

The surface roughness of the outer peripheral surface of the cylindrical part 13 is rougher than the surface roughness of the sliding contact surfaces with the piston 4 and the swash plate 3 of the spherical surface part 11 and the end surface part 12.

In this embodiment, the outer periphery end of the flange part 14 is provided so as to be located on the inside of an imaginary spherical surface S indicated by an imaginary line including the sliding surface 4*a* of the piston 4.

In particular, from the viewpoint of the stability of behavior of the shoe 5, it is desirable to make the configuration such that the relationship between the diameter d1 of the flange part 14 and the diameter d2 on the end surface part 12 side of the cylindrical part 13 is $d1/d2 \geq 1.05$.

Also, the outer periphery end of the flange part 14 is formed so that the wall thickness thereof decreases from the proximal portion of the flange part 14 toward the outer periphery thereof. Specifically, the outer periphery end of the flange part 14 is formed so that the shape on the piston 4 side of the flange part 14 tilts to the swash plate 13 side from the boundary portion with the cylindrical part 13 toward the outer periphery.

According to the swash plate type compressor 1 having the above-described configuration, by the rotation of the swash plate 3, the shoe 5 is oscillated along the sliding surface 4*a* of the piston 4 while tilting according to the angle of the swash plate 3, so that the rotation of the swash plate 3 is converted to the reciprocating movement of the piston 4.

According to the shoe 5 of this embodiment, since the flange part 14 is formed so as to be located on the inside of the imaginary spherical surface S of the sliding surface 4*a*, even if the shoe 5 is tilted by the rotation of the swash plate 3, the flange part 14 does not interfere with the sliding surface 4*a* of the piston 4.

On the other hand, as shown in a lower portion of FIG. 2, when the shoe 5 oscillates and the flange part 14 comes close to the sliding surface 4*a*, a space s is formed by the sliding surface 4*a*, the cylindrical part 13, and the flange part 14.

Thereby, the volume of the shoe 5 can be decreased by the volume of the space s located on the inside of the imaginary spherical surface S, and accordingly the weight of the shoe 5 can be decreased as compared with the conventional shoe. Therefore, the coating abrasion of the swash plate 3 caused by a hammering load resulting from the reciprocating movement of the piston 4 can be prevented as far as possible.

Due to the lighter weight, the posture of the shoe 5 can be prevented from becoming unstable on account of the increase in a clearance between the shoe 5 and the swash plate 3. Also, in some cases, by omitting a part or the whole of the coating, the cost of the swash plate 3 can be lowered.

Specifically, a swash plate as described, for example, in International Publication No. WO 2002/075172 or Japanese Patent Laid-Open No. 2006-161801 can be used.

Further, vibrations caused by the hammering load can be absorbed by the deformation of the flange part 14. In particular, by forming the flange part 14 so that the wall thickness thereof decreases toward the outer periphery, vibrations caused by the hammering load can be restrained satisfactorily, and an oil film can be formed properly between the end surface part 12 and the swash plate 3 by the lubricant.

Next, the movement of the lubricant or refrigerant flowing in the swash plate type compressor 1 is explained. Hereunder, explanation is given assuming that FIG. 2 shows the state in which the piston 4 moves from the left-hand side to the right-hand side in the figure, and thereby the shoe 5 is tilted to the maximum angle while rotating in the clockwise direction in the figure.

On the lower side in the figure of the shoe 5, the flange part 14 is close to the opening side of the sliding surface 4*a* of the piston 4. However, the opening of the sliding surface 4*a* is not closed because the flange part 14 is located in the inside of the imaginary spherical surface S of the sliding surface 4*a*.

Therefore, the lubricant or refrigerant flows into the space s formed by the sliding surface 4*a*, the cylindrical part 13, and the flange part 14 through a gap between the outer periphery end of the flange 14 and the opening of the sliding surface 4*a* of the piston 4.

Since the surface roughness of the outer peripheral surface of the cylindrical part 13 is rougher than that of the sliding surface 4*a* and the spherical surface part 11, if the lubricant or refrigerant flowing into the space s sticks to the outer peripheral surface of the cylindrical part 13, the lubricant or refrigerant stays on the surface of the cylindrical part 13.

Since the shoe 5 rotates in the clockwise direction in the figure, the lubricant or refrigerant sticking to the outer peripheral surface of the cylindrical part 13 is caused to flow from the left-hand side to the right-hand side in the figure by the inertial force created by the rotation of the shoe 5 and the resistance force created by the atmosphere in the swash plate type compressor 1. Therefore, convection in the clockwise direction in the figure caused by the lubricant or refrigerant is produced in the space s.

As a result, the lubricant or refrigerant sticking to the outer peripheral surface of the cylindrical part 13 is accumulated in a concavity formed at the boundary between the cylindrical part 13 and the flange part 14, and foreign matters mixed in the lubricant or refrigerant are also accumulated in this concavity.

According to the shoe 5 of this embodiment, the intermediate portion of the cylindrical part 13 is formed as the expanded part 13*a*, a larger amount of lubricant or refrigerant can be accumulated by the constricted part 13*b* formed adjacent to the expanded part 13*a*, and a larger amount of foreign matters can be accumulated.

Since the flange 14 is formed so that the wall thickness thereof decreases toward the outer periphery thereof, the lubricant or refrigerant accumulated in the concavity flows along the flange 14, and then flows in between the shoe 5*a* and the swash plate 3 through a portion between the relief shape 14*a* of the flange 14 and the swash plate 3 to provide lubrication.

On the other hand, the foreign matters accumulated in the concavity cannot flow beyond the flange 14 owing to the surface tension of the lubricant or refrigerant accumulated in the concavity. Therefore, the foreign matters are inhibited from entering a portion between the shoe 5 and the swash plate 3.

Next, when the shoe 5 is rotating in the clockwise direction in the figure, on the upper side in the figure of the shoe 5, the flange part 14 moves in the direction such as to separate from the sliding surface 4*a* of the piston 4, so that the lubricant or refrigerant sticking to the outer peripheral surface of the cylindrical part 13 is caused to flow from the right-hand side to the left-hand side in the figure by the inertial force created by the rotation of the shoe 5 and the resistance force created by the atmosphere in the swash plate type compressor 1.

As a result, the lubricant or refrigerant sticking to the outer peripheral surface of the cylindrical part 13 flows from the cylindrical part 13 toward the spherical surface part 11, and the lubricant or refrigerant accumulated in the concavity flows toward the spherical surface part 11 beyond the expanded part 13*a*.

On the other hand, the foreign matters accumulated in the concavity are inhibited from moving to the spherical surface part 11 by the expanded part 13*a*, so that the foreign matters are inhibited from entering a portion between the spherical surface part 11 and the sliding surface 4*a*.

Figure 3:
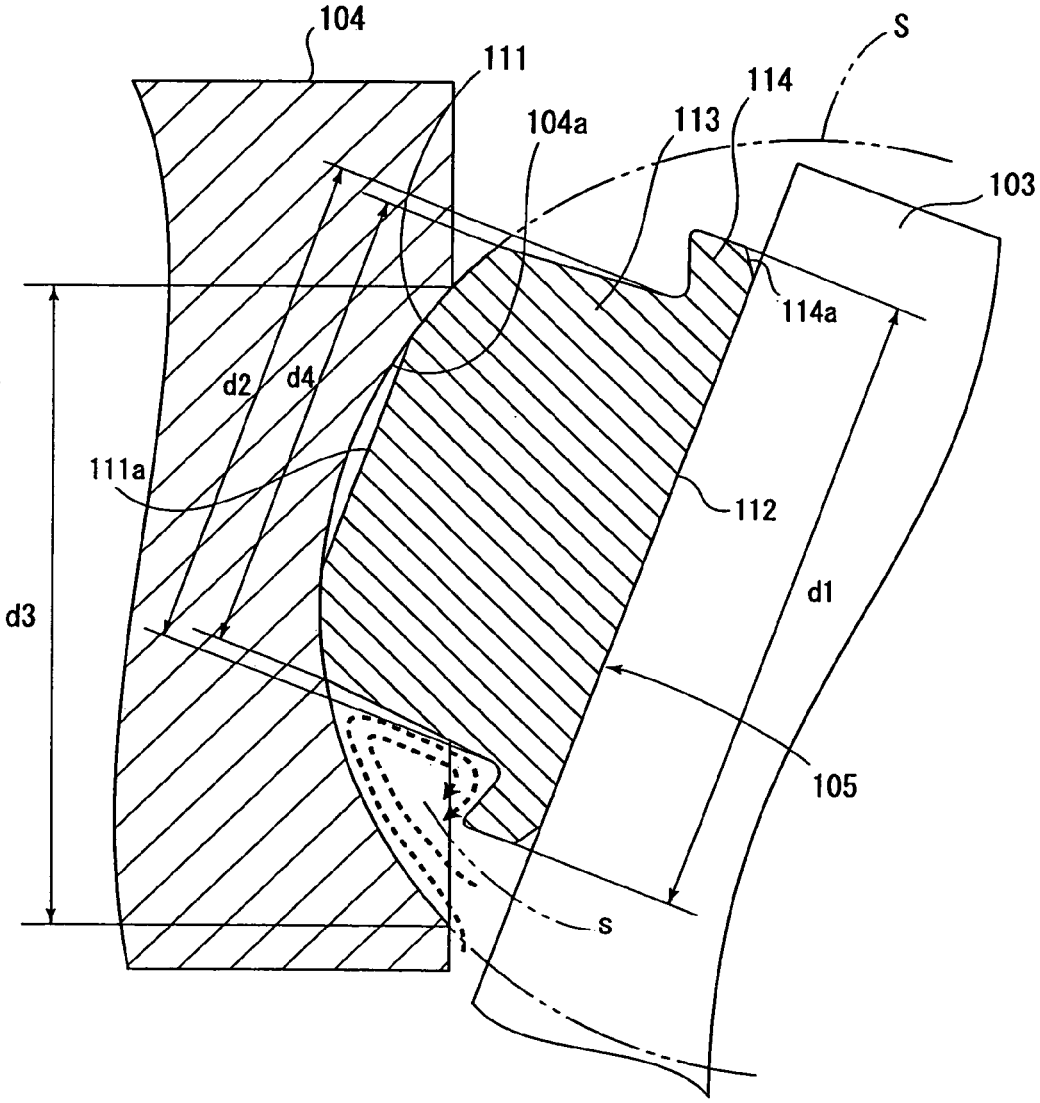
FIG. 3 is an enlarged sectional view of a shoe in a second embodiment.

FIG. 3 is a sectional view of a swash plate type compressor 101 of a second embodiment of the present invention, enlargedly showing portion II in FIG. 1 as in the first embodiment. In the explanation below, a symbol obtained by adding 100 to the symbol in FIG. 2 is applied to an element that is the same as the element of the first embodiment.

A cylindrical part 113 of a shoe 105 in this embodiment has a tapered shape such that the diameter thereof decreases from an end surface part 112 toward a spherical surface part 111. The diameter d2 on the end surface part 112 side of the cylindrical part 113 is smaller than the diameter d4 of the spherical surface part 111, and is smaller than the diameter d3 of the opening of a sliding surface 104*a* of a piston 104.

Like the shoe 5 of the first embodiment, the outer periphery end of a flange part 114 is located on the inside of the imaginary spherical surface S including the sliding surface 104*a* of the piston 104. Also, from the viewpoint of the stability of behavior of the shoe 105, it is desirable to make the configuration such that the relationship between the diameter d1 of the flange part 114 and the diameter d2 on the end surface part 112 side of the cylindrical part 113 is $d1/d2 \geq 1.05$.

Also, the outer periphery end of the flange part 114 is formed so as to project to the spherical surface 111 side with respect to the proximal portion of the flange part 114.

According to the swash plate type compressor 1 provided with the shoe 105 having such a configuration, even if the shoe 105 oscillates in the sliding surface 104*a* of the piston 104 with the rotation of a swash plate 103, the flange part 114 does not come close to the sliding surface 104*a* of the piston 104.

Therefore, the lubricant or refrigerant which flows through the inside of the swash plate type compressor 1 flows into the space s formed by the cylindrical part 113 and the sliding surface 104*a* through a gap between the outer periphery end of the flange 114 and the opening of the sliding surface 104*a* of the piston 104.

In other words, the flange part 114 does not come close to a further outer peripheral part of the opening of the sliding surface 104*a*, and does not close the opening. Therefore, the inflow of the lubricant into the space s is not hindered.

Thereafter, the lubricant flows from the sliding surface 104*a* of the piston 104 to the flange part 114 side via the cylindrical part 113 of the shoe 105, and subsequently flows again to the sliding surface 104*a* along the flange part 114. Therefore, the lubricant can circulate in the space s.

As a result, the lubricant can be held in the space s, and the sliding surface 104*a* of the piston 104 and the spherical surface part 111 of the shoe 105 can be lubricated satisfactorily by this lubricant.

Also, since the outer periphery end of the flange part 114 projects toward the spherical surface part 111, the flow of the lubricant can be directed to the interior of the space s. Therefore, the lubricant can be inhibited from being discharged easily from between the outer periphery end of the flange part 114 and the opening of the sliding surface 104*a* of the piston 104.

The hammering load resulting from the reciprocating movement of the piston 104 can be absorbed by the deformation of the flange part 114. Therefore, an effect of restraining vibrations caused by the hammering load can be achieved, and also the deformation of the flange part 114 can form an oil film properly between the end surface part 112 and the swash plate 103 by means of the lubricant.

Further, since the cylindrical part 113 is of a tapered shape such that the diameter thereof decreases from the end surface part 112 toward the spherical surface part 111, the volume of the space s can be increased, which accommodates a larger amount of lubricant, and contributes to the further reduction in weight.

The lubricant or refrigerant sticking to the outer peripheral surface of the cylindrical part 113 is accumulated in a concavity formed at the boundary between the cylindrical part 113 and the flange part 114, and foreign matters mixed in the lubricant or refrigerant also accumulate in this concavity.

According to the shoe 105 of this embodiment, since the outer periphery end of the flange part 114 projects toward the spherical surface part 111, a larger amount of lubricant or refrigerant can accumulate in the above-mentioned concavity, and also a larger amount of foreign matters can accumulate.

Figure 4:
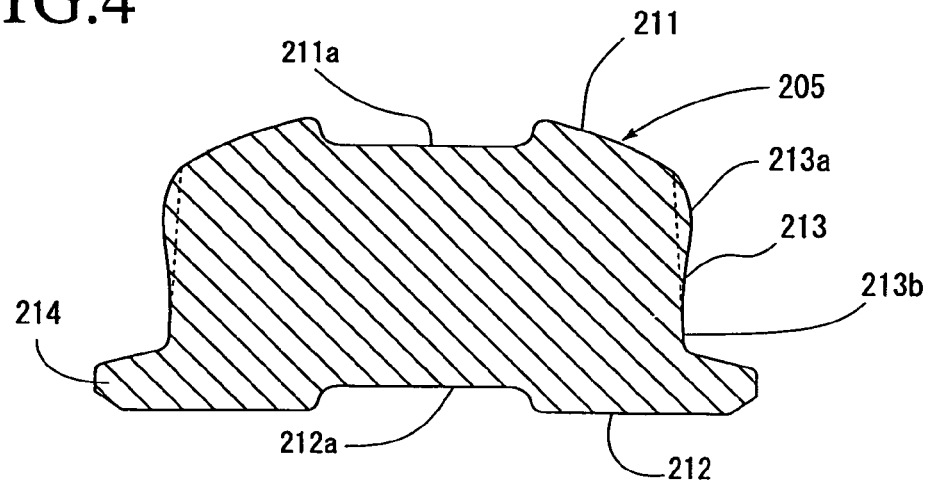
FIG. 4 is a sectional view of a shoe in a third embodiment.

FIG. 4 is a sectional view of a shoe 203 provided in a swash plate type compressor 201 of a third embodiment. The shoe 203 basically has the same configuration as that of the shoe 5 of the first embodiment. In the third embodiment, a symbol obtained by adding 200 to the symbol in FIG. 2 is applied to an element that is common to the element of the first embodiment, and the detailed explanation of that element is omitted.

For the shoe 205, unlike the shoe 5 of the first embodiment, an expanded part 213*a* in the cylindrical part 213 is located on the spherical surface part 211 side, and a constricted part 213*b* is formed widely in the up and down direction.

By this configuration, a larger amount of lubricant or refrigerant can accumulate in the constricted part 13*b* than for the shoe 1 of the first embodiment.

In the centers of the spherical surface part 211 and an end surface part 212, recesses 211*a* and 212*a* are formed toward the interior of the shoe 205, respectively. Therefore, excellent lubrication performance is achieved by the lubricant or refrigerant accumulated in the recesses 211*a* and 212*a*.

Such recesses 211*a* and 212*a* may be provided in the shoe 105 of the second embodiment.

The shoes 5, 105 and 205 described in the above-described embodiments are one example, and a shoe in which the above-described embodiments are combined can also be used.

For example, the shoe 5 of the first embodiment may be provided with the flange part 114 projecting to the piston 104 side of the shoe 105 of the second embodiment. Also, the surface roughness of the cylindrical part 113 of the shoe 105 of the second embodiment may be made rougher than the surface roughness of the spherical surface part 111 and the end surface part 112.

In the first and second embodiments, the diameter d4 of the spherical surface part 11, 111 is made such that when the swash plate 3, 103 tilts with respect to the piston 4, 104, the spherical surface part 11, 111 is exposed from the opening of the sliding surface 4*a*, 104*a* of the piston 4, 104.

Contrarily, the diameter d4 may be such that even if the swash plate 3, 103 forms the maximum tilt angle with respect to the piston 4, 104, the spherical surface part 11, 111 is not exposed from the sliding surface 4*a*, 104*a* of the piston 4, 104. Thereby, the behavior of the shoe 5, 105 can be stabilized.

In the above-described embodiments, the cylindrical part 13, 213 is formed with the expanded part 13*a*, 213*a*, or the cylindrical part 113 is of a tapered shape. However, the outer peripheral surface of the cylindrical part 13, 113, 213 may be of a free molded shape not subjected to any fabrication because it is not in sliding contact with both of the swash plate and the piston.

DESCRIPTION OF SYMBOLS

1 swash plate type compressor
3 swash plate
4 piston
4*a* sliding surface
5 shoe
11 spherical surface part
12 end surface part
13 cylindrical part
14 flange part
S imaginary spherical surface

The invention claimed is:

1. A swash plate type compressor comprising a swash plate rotating with a rotating shaft; a piston which advances and retreats with the rotation of the swash plate and is formed with a hemispherical concave sliding surface; and a shoe formed with a flat end surface part in sliding contact with the swash plate and a spherical surface part in sliding contact with the sliding surface of the piston, wherein a cylindrical part is formed between the spherical surface part and the end surface part of the shoe, and the shoe is formed with a flange part which projects to the outside in the radial direction from the cylindrical part in a boundary portion between the cylindrical part and the end surface part and is in sliding contact with the swash plate; and the flange part and an outer peripheral end thereof are located on the inside of an imaginary spherical surface including the hemispherical concave sliding surface of the piston, and the diameter of the cylindrical part is smaller than the diameter of an opening of the sliding surface of the piston.

2. The swash plate type compressor according to claim 1, wherein on the outer peripheral surface of the cylindrical part, an intermediate portion between the spherical surface part and the end surface part of the cylindrical part is formed as an expanded part expanded to the outside in the radial direction.

3. The swash plate type compressor according to claim 2, wherein on the outer peripheral surface of the cylindrical part, a constricted part having a diameter smaller than that of the expanded part is further formed between the expanded part and the flange part.

4. The swash plate type compressor according to claim 1, wherein the cylindrical part has a tapered shape such that the diameter thereof decreases from the end surface part toward the spherical surface part.

5. The swash plate type compressor according to claim 1, wherein the wall thickness of the flange part decreases from a proximal portion of the flange part toward the outer periphery thereof.

6. The swash plate type compressor according to claim 1, wherein the outer periphery end of the flange part projects to the spherical surface part side with respect to a proximal portion of the flange part.

7. The swash plate type compressor according to claim 1, wherein the surface roughness of the cylindrical part is rougher than the surface roughness of the spherical surface part and the end surface part.

8. The swash plate type compressor according to claim 1, wherein the relationship between the diameter d1 of the flange part and the diameter d2 on the end surface part side of the cylindrical part is $d1/d2 \geq 1.05$.

9. A swash plate type compressor comprising a swash plate rotating with a rotating shaft; a piston which advances and retreats with the rotation of the swash plate and is formed with a hemispherical concave sliding surface; and a shoe formed with a flat end surface part being in sliding contact with the swash plate and a spherical surface part being in sliding contact with the sliding surface of the piston, wherein a cylindrical part is formed between the spherical surface part and the end surface part of the shoe, and the shoe is formed with a flange part which projects to the outside in the radial direction from the cylindrical part in the boundary portion between the cylindrical part and the end surface part and is in sliding contact with the swash plate;

the flange part is located on the inside of an imaginary spherical surface including the hemispherical concave sliding surface of the piston, and the diameter of the cylindrical part is smaller than the diameter of the opening of the sliding surface of the piston;

on the outer peripheral surface of the cylindrical part, an intermediate portion between the spherical surface part and the end surface part of the cylindrical part is formed as an expanded part expanded to the outside in the radial direction; and on the outer peripheral surface of the cylindrical part, a constricted part having a diameter smaller than that of the expanded part is further formed between the expanded part and the flange part.

* * * * *